United States Patent [19]

Alvarez

[11] Patent Number: 4,512,381

[45] Date of Patent: Apr. 23, 1985

[54] INTERCHANGABLY HEADED TOOL

[76] Inventor: Ernest Alvarez, 6040 Madison St., Ridgewood, N.Y.

[21] Appl. No.: 592,833

[22] Filed: Mar. 23, 1984

[51] Int. Cl.[3] ..... B25C 1/00

[52] U.S. Cl. ..... 145/29 R; 30/340; 30/342; 145/2 R; 145/36; 145/108 R

[58] Field of Search ..... 145/29 R, 36, 2 R, 108 R, 145/24, 3; 30/344, 342, 340

[56] References Cited

U.S. PATENT DOCUMENTS

| | | | |
|---|---|---|---|
| D. 33,137 | 8/1900 | Duffy | 145/2 R |
| 1,718,031 | 6/1929 | Clemson | 145/108 R |
| 1,997,131 | 4/1935 | Champlin | 30/342 |
| 2,282,902 | 5/1942 | Sultan | 145/108 R |
| 2,676,406 | 4/1954 | Hoke | 30/342 |

FOREIGN PATENT DOCUMENTS

| | | | |
|---|---|---|---|
| 242854 | 1/1912 | Fed. Rep. of Germany | 30/340 |
| 987767 | 4/1951 | France | 145/29 R |
| 16921 | of 1899 | United Kingdom | 145/108 R |
| 749859 | 6/1956 | United Kingdom | 145/2 R |

*Primary Examiner*—Frederick R. Schmidt
*Assistant Examiner*—J. T. Zatarga
*Attorney, Agent, or Firm*—Howard M. Schwinger

[57] ABSTRACT

An interchangably headed tool including an elongated handle having at one end thereof a longitudinal passage formed therein, a head for said handle, said head having a shank extending therefrom, said shank extending into the passage, a portion of the wall forming the longitudinal passage including a removable clamping plate adapted to abut the shank and clamp the head firmly in place.

2 Claims, 6 Drawing Figures

INTERCHANGABLY HEADED TOOL

This invention relates to tools and more particularly, to a tool adapted to receive a plurality of heads.

Although interchangably headed tools have been successfully devised for many purposes, such a tool has not been devised for high impact purposes such as hammering.

It is thus an important object of this invention to provide a handle capable of receiving and securely maintaining various heads.

It is still another object of the present invention to provide a hammer adapted to receive a plurality of heads.

It is another important object of the present invention to provide for a secure clamp of head to handle in a tool having interchangable heads.

Other objects and advantages of the present invention will become apparent from a reading of the following specification and drawing wherein.

SPECIFICATION

Figure 1:
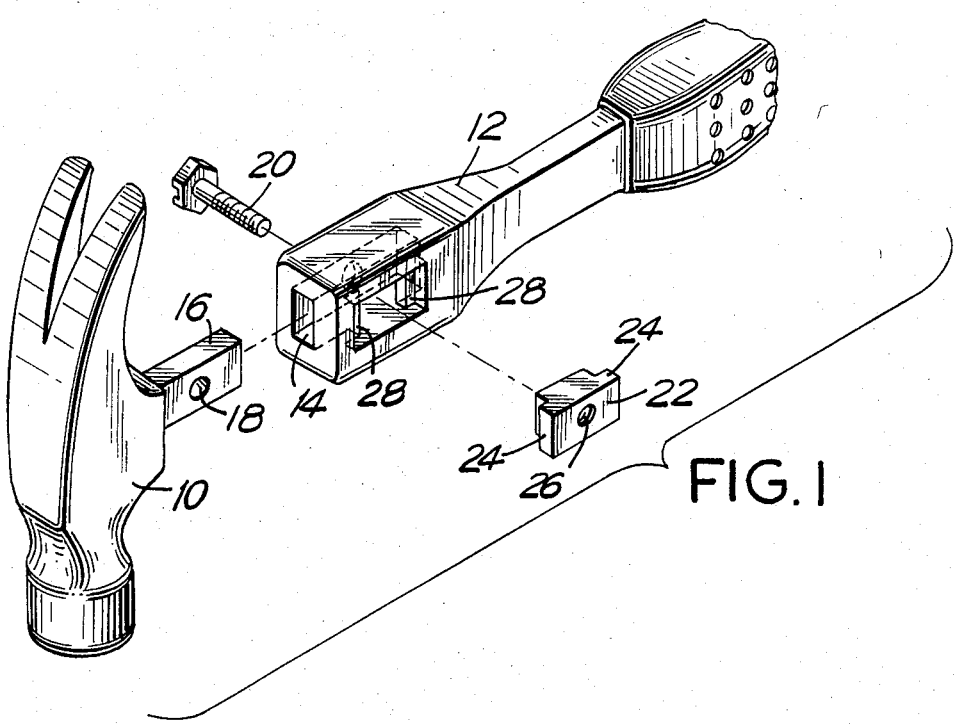
FIG. 1 is an exploded perspective view of an embodiment of a claw hammer in accordance with the present invention.
Figure 2:
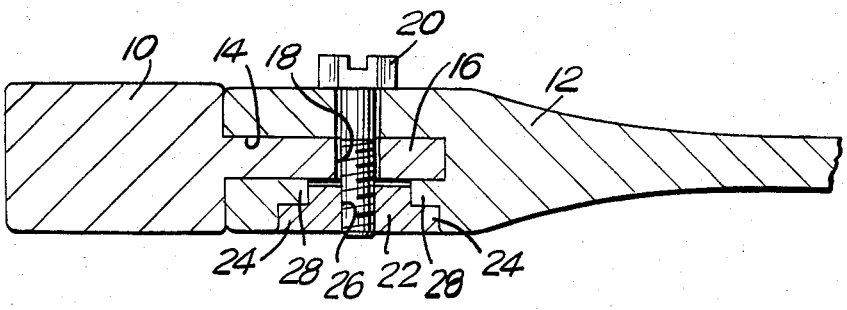
FIG. 2 is a sectional view of the assemblage of FIG. 1.

A hammer in accordance with the present invention is shown in FIG. 1 consisting of removable head 10 and handle 12. In this instance the removable head is a claw hammer head.

As may be seen, handle 12 is provided with passage 14 at one end thereof to receive shank 16 extending from head 10. Shank 16 is apertured at 18 to permit clamping screw 20 to pass through it to engage clamping plate 22 which is similarly apertured at 26 and internally threaded so that when screw 20 is tightened it will draw clamping plate 22 against shaft 16 to reliably clamp it within passage 14 regardless of the stress brought to bear upon the head.

Clamping plate 22 is provided with abutments 24 which abut posts 28 of the handle to enhance the clamping force in this embodiment of the invention.

Figure 3:
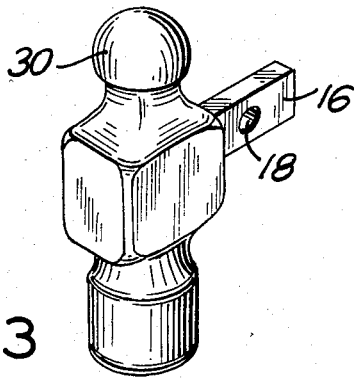
FIG. 3 shows a balpin head which may be employed in the hammer of the present invention.
Figure 4:
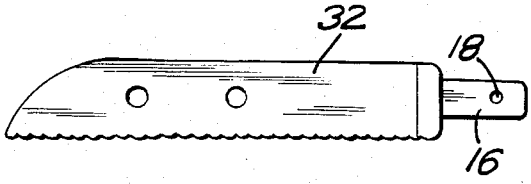
FIGS. 4, 5 and 6 show respectively, a saw blade, ax head and upholstery hammer head which may be used in the present invention.
Figure 5:
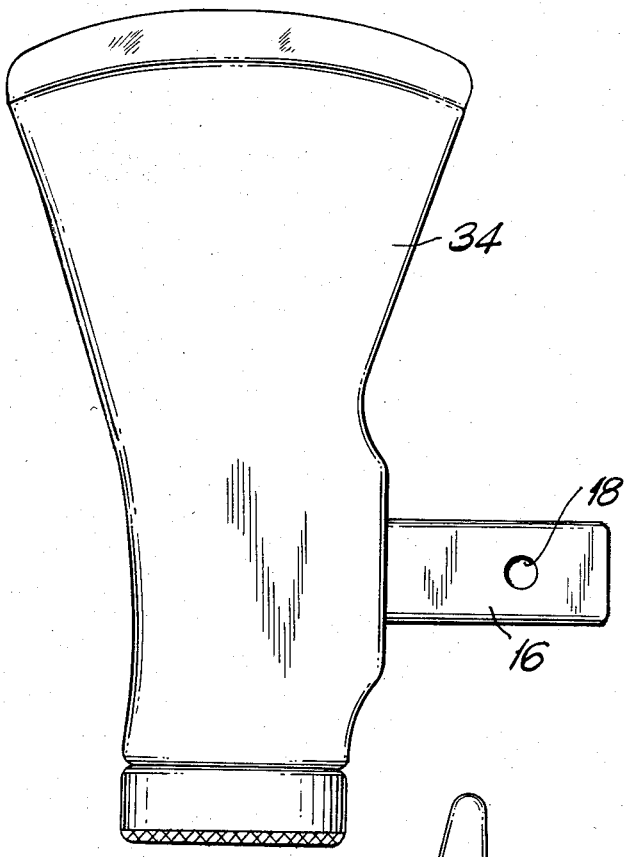
Figure 6:
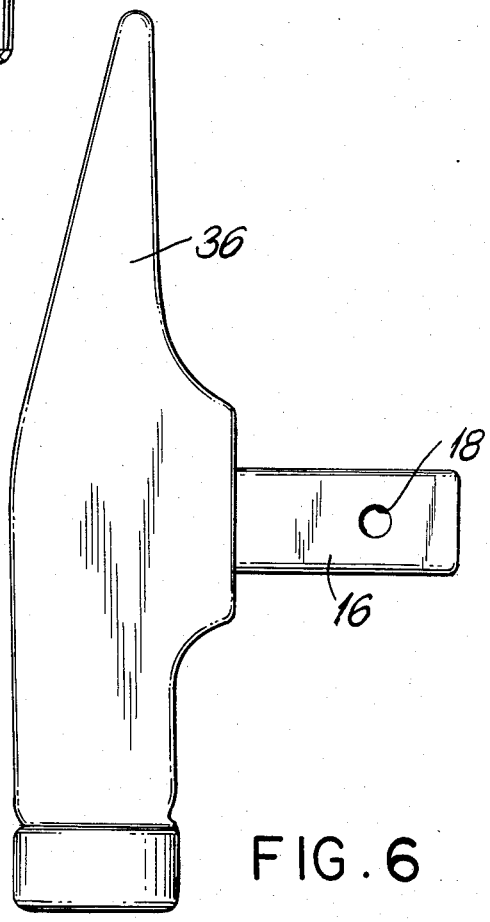

The present invention permits the balpin head 30 of FIG. 3 to be substituted for the claw hammer head of FIG. 1. Additionally, an ax or upholstery head may be thus employed as shown in FIGS. 5 and 6. Even a saw blade 32 may be incorporated with the handle as is shown in FIG. 4.

It will be realized that although only a few embodiments of the present invention have been illustrated herein, there are other embodiment which fall within the letter and the spirit of the appended claims.

I claim:

1. An interchangably headed tool comprising a handle having at one end thereof a longitudinal passage formed therein, an interchangable tool head for said handle, said head having a shank extending therefrom, said shank being insertable in said passage, a portion of the wall forming the longitudinal passage comprising a removable clamping plate adapted to abut the shank, said passage wall having posts formed therein to support said clamping plate, said clamping plate being recessed at its ends to abut the posts formed in the passage wall, said clamping plate having a threaded aperture, a clamping screw passing through the passage wall and shank to threadedly engage the clamping plate, said plate bringing clamping pressure to bear upon the shank as the screw is tightened.

2. An interchangably headed hammer comprising a hammer handle having at one end thereof a longitudinal passage formed therein, a head for said hammer, said head having a shank extending therefrom, said shank being insertable in said passage, said shank being disposed within the passage, a portion of the wall forming the passage comprising a removable clamping plate adapted to abut the shank, said passage wall having posts formed therein to support said clamping plate, said clamping plate being recessed at its ends to abut the posts formed in the passage wall, said clamping plate having a threaded aperture, a clamping screw passing through the passage wall and shank to threadedly engage the clamping plate, said plate bringing clamping pressure to bear upon the shank as the screw is tightened.

* * * * *